US011577864B2

(12) United States Patent
Brosch et al.

(10) Patent No.: US 11,577,864 B2
(45) Date of Patent: Feb. 14, 2023

(54) RECYCLABLE POUCH HAVING RESEAL CLOSURE OVERLAPPING AN EDGE SEAL, FORMED FROM ROLLSTOCK FILM, ON HIGH SPEED PACKAGING MACHINERY

(71) Applicant: General Mills, Inc., Minneapolis, MN (US)

(72) Inventors: Mychal Brosch, Chanhassen, MN (US); Peter L. Novotny, Crystal, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 17/286,122

(22) PCT Filed: Oct. 28, 2019

(86) PCT No.: PCT/US2019/058295

§ 371 (c)(1),
(2) Date: Apr. 16, 2021

(87) PCT Pub. No.: WO2020/092206

PCT Pub. Date: May 7, 2020

(65) Prior Publication Data

US 2021/0387758 A1 Dec. 16, 2021

Related U.S. Application Data

(60) Provisional application No. 62/752,716, filed on Oct. 30, 2018.

(51) Int. Cl.

| | |
|---|---|
| ***B65B 9/08*** | (2012.01) |
| ***B65B 5/02*** | (2006.01) |
| ***B65B 9/02*** | (2006.01) |
| ***B65B 41/12*** | (2006.01) |
| ***B65B 43/06*** | (2006.01) |
| ***B65B 51/26*** | (2006.01) |
| ***B65B 61/18*** | (2006.01) |
| ***B65D 33/25*** | (2006.01) |

(52) U.S. Cl.
CPC ..... *B65B 9/08* (2013.01); *B65B 5/022* (2013.01); *B65B 9/02* (2013.01); *B65B 41/12* (2013.01);
(Continued)

(58) Field of Classification Search
CPC B65B 5/022; B65B 5/04; B65B 41/12; B65B 61/188; B65B 9/02; B65B 9/08;
(Continued)

(56) References Cited

U.S. PATENT DOCUMENTS 4,997,416 A * 3/1991 Mitchell ..... B29C 66/73116 493/341
9,468,266 B2 10/2016 Ducauchuis et al.
(Continued)

FOREIGN PATENT DOCUMENTS

EP 0135649 4/1985

OTHER PUBLICATIONS

APLIX, "Easy-Lock Touch—An Easy Closure for Small Bags", Jun. 24, 2016, 2 pages.
(Continued)

*Primary Examiner* — Thomas M Wittenschlaeger
(74) *Attorney, Agent, or Firm* — Diederiks & Whitewlaw, PLC; Taylor Moore-Willis, Esq.

(57) ABSTRACT

Recyclable pouches formed from rollstock and having a resealable closure that extends into both side edges of the pouch may be produced at high speeds on a single manufacturing line in which the pouches are formed, cut apart, filled, and then sealed if the film forming the pouch comprises a recyclable heat seal layer and a second recyclable layer having a melting temperature of at least 30° C. greater than the heat seal layer.

12 Claims, 10 Drawing Sheets

(52) U.S. Cl.
CPC ..... *B65B 43/06* (2013.01); *B65B 51/26* (2013.01); *B65B 61/188* (2013.01); *B65D 33/2508* (2013.01)

(58) Field of Classification Search
CPC ..... B65B 43/06; B65B 51/26; B65D 33/2508; B31B 70/8132; B31B 70/262; B31B 70/36; B31B 2155/0014; B31B 2160/10
See application file for complete search history.

(56) References Cited

U.S. PATENT DOCUMENTS

| | | | | |
|---|---|---|---|---|
| 2012/0207412 | A1 | 8/2012 | Moehlenbrock et al. | |
| 2014/0328552 | A1* | 11/2014 | Sanfilippo ..... | B65B 61/184 383/84 |
| 2016/0339663 | A1 | 11/2016 | Clare | |
| 2017/0183110 | A1* | 6/2017 | Garthaffner ..... | B65B 57/14 |

OTHER PUBLICATIONS

"Automatic High Speed 3 Side Seal Zipper & Stand-up Pouch Making Machine", Model Galaxy GS-20 HS, https://www.youtube.com/watch?v=fjrSjkhPIpg, last visited on Apr. 14, 2021.

Frain Industries, "Doboy-Bosch Pack 101 Horizontal Flow Wrapper Demonstration", https://www.youtube.com/watch?v=Wok3ahuql1Y, last visited on Apr. 14, 2021.

"Robert's Packaging C Series HFFS", https://www.youtube.com/watch?v=KZZfyw8eqs8, last visited on Apr. 14, 2021.

International Search Report and Written Opinion from PCT Application No. PCT/US2019/058295 dated Jan. 6, 2020, 9 pages.

Zip Pak, "Product Specifications Part #645-021", Mar. 21, 2016, 1 page.

Zip Pak, "Product Specifications Part #611-021", Aug. 5, 2014, 1 page.

* cited by examiner

RECYCLABLE POUCH HAVING RESEAL CLOSURE OVERLAPPING AN EDGE SEAL, FORMED FROM ROLLSTOCK FILM, ON HIGH SPEED PACKAGING MACHINERY

RELATED APPLICATION

This application claims the benefit of U.S. Provisional Application No. 62/752,716, filed Oct. 30, 2018, the disclosure of which is incorporated by reference herein in its entirety.

FIELD

This disclosure generally relates to, among other things, methods for manufacturing recyclable pouches in which a resealable closure overlaps with an edge seal of the pouch. The methods described in this disclosure may be particularly applicable to horizontal form-fill-seal processes or other processes in which the pouch is formed, filled, and sealed on a single manufacturing line.

BACKGROUND

Standup pouches are a significantly growing packaging format due to their convenience and ease of manufacturing. Standup pouches are typically made from multi-material non-recyclable laminations. Yet, consumers often desire packaging to be recyclable. However, recyclable materials for pouches lack the heat resistance required for integrating traditional resealable closures like press-to-close zippers at high speed on existing packaging equipment.

Non-recyclable pouches having resealable closures may be readily formed at high speed on existing packaging equipment, such as horizontal form-fill-seal equipment. The pouches typically contain an inner heat seal layer and a non-recyclable, heat resistant outer layer having a high melting temperature. High temperatures are required when incorporating the reseal closure across the width of the package at high speeds, mainly because the reseal closure at the side edges of the package need to be sufficiently flattened to ensure a proper edge seal along the length of the package.

Recyclable pouches having a resealable closure that overlaps with an edge seal are currently available as premade packages, decoupled from the forming and sealing process. However, the processes for manufacturing such pouches include many steps, which translate to significantly less thermal stress to the film (web) during fabrication. Such pouches are time consuming to make and are priced at a premium. For example, current processes include constructing, cutting, forming and stacking into boxes recyclable pouches having resealable closures but do not have a top edge sealed. After transport to an appropriate facility, the pouches are separated and indexed, opened, and filled, and then the top edge is sealed. Specific packaging machinery is required to run these pre-made pouches. The machinery is configured to pick, open, then fill and seal each pre-made pouch

SUMMARY

This disclosure describes, among other things, a process for producing recyclable pouches having a resealable closure that extends to an edge of the pouch. The processes may be performed at high speeds. The processes may be performed on a single manufacturing line in which the pouches are formed, filled, and sealed. For example, the process may be a horizontal form-fill-seal process.

In various embodiments, the processes described herein include crushing edges of the resealable closure prior to or after heat sealing the pouch along its side edges. The heat seal overlaps with the crushed edges of the closure. To achieve high speed production, such as at least 70 pouches per minute, the dwell time of crushing apparatus on the film is less than one second, such as 0.5 seconds or less. To sufficiently flatten the closure to complete the heat seal along the edges or so that a suitable heat seal may be later formed along the entire side edge of the pouch, the temperature of the crushing apparatus that contacts the pouch walls must be sufficiently high due to the short dwell time. The inventors have found that having a film with an outer layer having a melting temperature of at least about 30° C. greater than the melting temperature of the inner heat seal layer provides sufficient temperature resistance and heat transfer to achieve sufficient heat to be applied to achieve sufficient flattening for a quality seal to be formed without compromising the integrity of the outer layer of the film. The inventors have also found that employing closures that have reduced mass or density, relative to more conventionally employed closures, may allow melting or deformation at temperatures, pressures, and dwell times that permit high speed production.

In various embodiments, a method for forming a filled recyclable pouch having a sealing closure that extends into side edges of the pouch from film rollstock, is described herein. The method includes providing a multi-ply film having a heat seal layer and a second layer having a melting temperature of at least 30° C. greater than a melting temperature of the heat seal layer. The multi-ply film is recyclable. The method further comprises providing an elongate source of resealable closure and providing an article to be placed in the pouch. The method also comprises advancing a leading portion of the multi-ply film from the rollstock; folding the advancing film such that the heat seal layer on a first side of the folded film is adjacent the heat seal layer on a second side of the folded film; and applying the elongate source of resealable closure to the folded film such that the elongate source of resealable closure contacts the heat seal layer of the first side of the folded film and contacts the heat seal layer of the second side of the folded film. The method further comprises applying heat and pressure to the folded film and applied elongate source of resealable closure to seal the elongate source of resealable closure to the heat seal layers of the first and second sides of the folded film. The heat and pressure are applied to locations of the folded film that correspond to the side edges of the pouch to be formed. The application of heat and pressure cause the elongate source of resealable closure to sufficiently flatten at locations that correspond to the side edges of the pouch to be formed. The method also comprises applying heat and pressure to the folded film with the applied elongate source of resealable closure to seal the heat seal layers of the first and second sides of the folded film. The heat and pressure are applied to locations of the folded film that correspond to side edges of the pouch to be formed. The method further includes cutting the folded film with the sealed elongate source of resealable closure and side edge seals to form pouches having a bottom, sealed side edges, an unsealed top, and a sealing closure between the bottom and the top and extending to the side edges. The method also includes filling the pouch with an article, and sealing top of the pouch. Formed, cut apart, filled, and then sealed pouches using film rollstock format (vs. pre-made pouches) may be produced at a rate of at least 70 pouches per minute.

The side edges of the closure may be crushed prior to or after the side edges are heat sealed. If the side edges are heat sealed prior to crushing the closure, portions of the side edges in proximity to the closure are preferably unsealed and the step of crushing the side edges of the closure may complete the seal along the length of the sides of the pouch to be formed.

One or more embodiments of the films, packages, packaged articles, and methods described herein provide one or more advantages over prior films, packages, packaged articles, and methods. Such advantages will be readily understood from the following detailed description.

Figure 1:
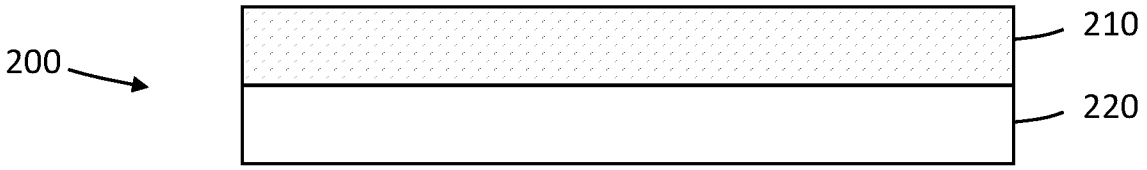
FIG. 1 is a schematic cross-sectional view of an embodiment of a multi-ply film for use in manufacturing an embodiment of a recyclable pouch.

The schematic drawings are not necessarily to scale. Like numbers used in the drawings refer to like components, steps and the like. However, it will be understood that the use of a number to refer to a component in a given drawing is not intended to limit the component in another drawing labeled with the same number. In addition, the use of different numbers to refer to components in different drawings is not intended to indicate that the different numbered components cannot be the same or similar to other numbered components.

Reference will now be made in greater detail to various embodiments of the subject matter of the present disclosure, some embodiments of which are illustrated in the accompanying drawings.

DETAILED DESCRIPTION

This disclosure describes, among other things, a process for producing recyclable pouches having a resealable closure that extends into both side edges of the pouch. Preferably, the process is performed on a single manufacturing line in which film rollstock is fed at the front end, and pouches are subsequently formed, filled, and then sealed (vs. premades). Preferably, the processes are performed at high speed. Preferably, the process is performed at high speed on a single manufacturing line in which film rollstock is fed at the front end, and pouches are subsequently formed, cut apart, filled, and then sealed. In some embodiments, the processes described herein are performed on horizontal form-fill-seal equipment.

The processes described herein may be used to produce any suitable recyclable pouch comprising a resealable closure that extends to side edges of the pouch from rollstock, on HFFS machinery. A recyclable pouch may be formed from a film having a melting temperature of about 145° C. or less. Preferably, the film has a melting temperature of about 140° C. or less, such as 130° C. or less. In some embodiments, the film has a melting temperature between about 110° C. and about 135° C.

Melting temperature of a film may be determined in any suitable manner. For example, the melting temperature of the film may be determined by differential scanning calorimetry.

Preferably, the recyclable film rollstock comprises polyethylene. Preferably, the recyclable film comprises 50% to 100% polyethylene. For example, the film may comprise 60% or more polyethylene by weight, such as 70% or more polyethylene by weight, 80% or more polyethylene by weight or 90% or more polyethylene by weight.

Hereinafter, the term "polyethylene" is used (unless indicated otherwise) to refer to ethylene homopolymers as well as copolymers of ethylene with at least one other monomer and the term will be used without regard to the presence or absence of substituent branch groups. Preferably, the polyethylene is a homopolymer or a copolymer formed from 50% or more by weight ethylene.

Some examples of suitable monomers for forming copolymers with ethylene include alpha-olefins, vinyl acetates, and acrylates or methacrylates. Often polyethylenes are copolymers of ethylene with alpha-olefins, such as butene, hexane or oxene.

Any suitable polyethylene may be used. For example, the polyethylene may be very low density polyethylene (VLDPE), low density polyethylene (LDPE), linear low density polyethylene (LLDPE), medium density polyethylene (HDPE) or high density polyethylene (HDPE).

VLDPE, which may also be called "Ultra Low Density Polyethylene" (ULDPE), comprises copolymers of ethylene with alpha-olefins, usually 1-butene, 1-hexene or 1-octene and are recognized by those skilled in the art as having a high degree of linearity of structure with short branching rather than the long side branches characteristic of LDPE. However, VLDPEs have lower densities than LLDPEs. The densities of VLDPEs are recognized by those skilled in the art to range between 0.860 and 0.915 g/cm$^3$. Sometimes VLDPEs having a density less than 0.900 g/cm$^3$ are referred to as "plastomers".

LDPE is used to denominate branched homopolymers having densities between 0.910 and 0.940 g/cm$^3$. LDPEs typically contain long branches off the main chain with alkyl substituents of 2 to 8 carbon atoms.

LLDPE are copolymers of ethylene with alpha-olefins having densities from 0.915 to 0.925 g/cm$^3$. The alpha-olefin utilized may be 1-butene, 1-hexene, or 1-octene. Ziegler-type catalysts may be employed (although Phillips catalysts may also be used to produce LLDPE having densities at the higher end of the range, and metallocene and other types of catalysts may be also employed to produce other well-known variations of LLDPEs). An LLDPE produced with a metallocene or constrained geometry catalyst is often referred to as "mLLDPE".

Polyethylene that is an ethylene alpha-olefin copolymer preferably has ethylene as a major component copolymerized with one or more alpha olefins such as octene-1, hexene-1, or butene-1 as a minor component. Such polyethylenes include polymers known as LLDPE, VLDPE, ULDPE, and plastomers and may be made using a variety of processes and catalysts including metallocene, single-site and constrained geometry catalysts as well as Ziegler-Natta and Phillips catalysts.

MDPE may be produced using chromium/silica catalysts, Ziegler-Natta catalysts, or metallocene catalysts and has a density in a range between 0.926 and 0.940 g/cm$^3$.

HDPE has a low degree of branching and has a density of at least 0.941 g/cm$^3$. Due to the low degree of branching, the molecules pack together well. HDPE may be produced using chromium/silica catalysts, Ziegler-Natta catalysts, or metallocene catalysts. Appropriate selection of catalyst and reaction conditions may result in low degree of branching, and thus formation of HDPE.

Polyethylenes may be used alone or in blends with other polymers. If the polyethylene is used in a blend, the blend preferably comprises 50% or more by weight polyethylene. In some embodiments, different types of polyethylene, such as one or more of VLDPE, LDPE, LLDPE, MDPE, and HDPE, are blended and used to form a polyethylene film or layer.

In some preferred embodiments, the film rollstock comprises no more than 10% by weight polyvinyl chloride (PVC), polyvinylidene chloride (PVDC), polystyrene, polyurethane foam, polypropylene, and polyethylene terephthalate (PET). Preferably, the film comprises no more than 5% by weight PVC, PVDC, polystyrene, polyurethane foam, polypropylene, and PET. Even more preferably, the film comprises no more than 2% by weight PVC, PVDC, polystyrene, polyurethane foam, polypropylene, and PET or is substantially free of or free of PVC, PVDC, polystyrene, polyurethane foam, polypropylene, and PET.

The recyclable film rollstock is a multi-ply film. Preferably, the recyclable film is a two-layer multi-ply film that is coextruded or laminated. However, the film may have any other suitable number of "plys" or layers, such as 3, 4, 5, 6, 7, or 8 layers. Each layer of the multi-ply recyclable film may be recyclable. For example, each layer may comprise polyethylene and have a melting temperature of about 160° C. or less.

The recyclable film rollstock comprises a heat seal layer used to form an inner surface of a recyclable pouch and a second layer having a melting temperature sufficiently greater than the melting temperature of the heat seal layer such that heat of an appropriate temperature applied to the second layer results in melting of the heat seal layer but not the second layer. Preferably, the second layer has a melting temperature of at least 30° C. greater than the melting temperature of the heat seal layer. Preferably, the second layer forms an exterior surface of the pouch. The first and second layers may be coextruded, laminated, or the like.

In some embodiments, the second layer has a melting temperature of at least 40° C. greater than the melting temperature of the heat seal layer. For example, the second layer may have a melting temperature from about 40° C. to 60° C. about greater than the melting temperature of the heat seal layer.

In some embodiments, the melting temperature of the second layer is less than about 145° C. or less, such as less than about 140° C. For example, the melting temperature of the second layer may be in a range from about 110° C. to about 145° C.

In some embodiments, the heat seal layer has a melting temperature of about 130° C. or less, such as less than about 120° C. For example, the melting temperature of the second layer may be in a range from about 80° C. to about 120° C.

The composition and density of the layers of the film rollstock may be varied to achieve an appropriate temperature differential between the second layer and the heat seal layer. For example, the density of polyethylene, the amount and type of copolymers and blended polymers may be varied to vary the melting temperature of the heat seal layer or the second layer.

The heat seal layer preferably comprises ULDPE, LDPE or LLDPE. The second layer preferably comprises LDPE, LLDPE, MDPE or HDPE.

The heat seal layer may be of any suitable thickness. For example, the heat seal layer may have a thickness from about 0.5 mils (12.5 microns) to about 3 mils (75 microns), such as from about 1 mil (25 microns) to about 3 mils (75 microns), such as from about 1.5 mils (37.5 microns) to 3 mils (75 microns).

The second layer may be of any suitable thickness. For example, the second layer may have a thickness from about 0.5 mils (12.5 microns) to about 2 mils (50 microns), such as from about 1 mil (25 microns) to about 2 mils (50 microns).

The multilayer recyclable film rollstock may be of any suitable thickness. For example, the multilayer film may have a thickness from about 1 mil to about 5 mils.

The layer or ply of the film that will form the exterior surface of the pouch may comprise printing for the package. When the pouch is formed, the printing may be registered with the pouch forming equipment to ensure that each pouch, when ultimately formed, is properly printed.

A recyclable pouch formed from the recyclable film rollstock may include any suitable resealable closure. The resealable closure is preferably heat sealed to the interior heat seal layer of the pouch. The resealable closure may contain a heat seal layer or may be formed of material capable of forming a heat seal. Preferably, the heat seal layer or material of the closure comprises heat sealable polyethylene. The heat sealable polyethylene may be as discussed above regarding the film.

Preferably, the resealable closure is recyclable. For example, the resealable closure may comprise 50% or more polyethylene.

The resealable closure may have a low polymer mass or density to allow heat sealing and attachment to the film rollstock forming the pouch, on a high-speed HFFS manufacturing line without application of excessive heat. For example, the resealable closure may have a polymer density of 2.75 g per linear foot or less, such as 2.5 g per linear foot or less, or 2.0 g per linear foot or less. The resealable closure may comprise any suitable polymer material, such as a heat sealable polymer. In some embodiments, the resealable closure, or portions thereof are formed from polyethylene. Preferably, the heat sealable polymer, such as polyethylene, has a density of 2.75 g per linear foot or less, such as 2.5 g per linear foot or less, or 2.0 g per linear foot or less.

The resealable closure may be a zipper-type closure, a hook-to-hook type closure, a hook and loop type closure, or the like. The resealable closure may include a slider to facilitate closing or may not include a slider, depending on the type of closure employed. For example, the closure may comprise a flanged zipper with grip strips such as those available from Zip-Pak (Carol Stream, Ill.), an ITW Company, or a hook-to-hook resealable closure such as those available from APLIX, Inc. (Charlotte, N.C.). Examples of suitable resealable closures are described in, for example, U.S. Pat. Nos. 8,641,278 and 5,085,031, which are hereby incorporated herein by reference in their respective entireties to the extent that they do not conflict with the present disclosure.

The resealable closure may be derived from a supply of resealable closure material in rollstock format. For example, the source of resealable closure may comprise an elongate closure strip, which may be fed through pouch manufacturing equipment for attaching to a heat seal layer of a folded film.

Referring now to FIG. 1, a schematic cross-sectional view of a recyclable film 200 for forming a recyclable pouch rollstock is shown. The recyclable film 200 comprises a heat seal layer 210 and a second layer 220 having a melting temperature of at least about 30° C. greater than the heat seal layer 210. The heat seal layer 210 and the second layer 220 may be coextruded, laminated, or the like.

Figure 2A:
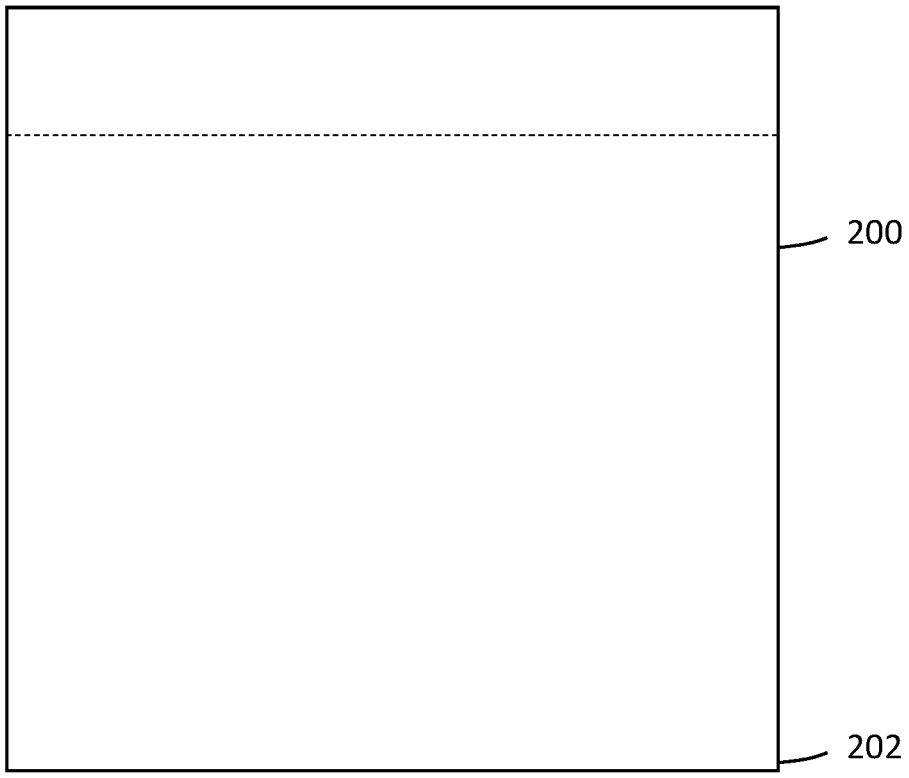
FIGS. 2A-D are schematic top plan views of an embodiment of a film and a resealable closure in initial steps of an embodiment of forming an embodiment of a recyclable pouch.
Figure 2B:
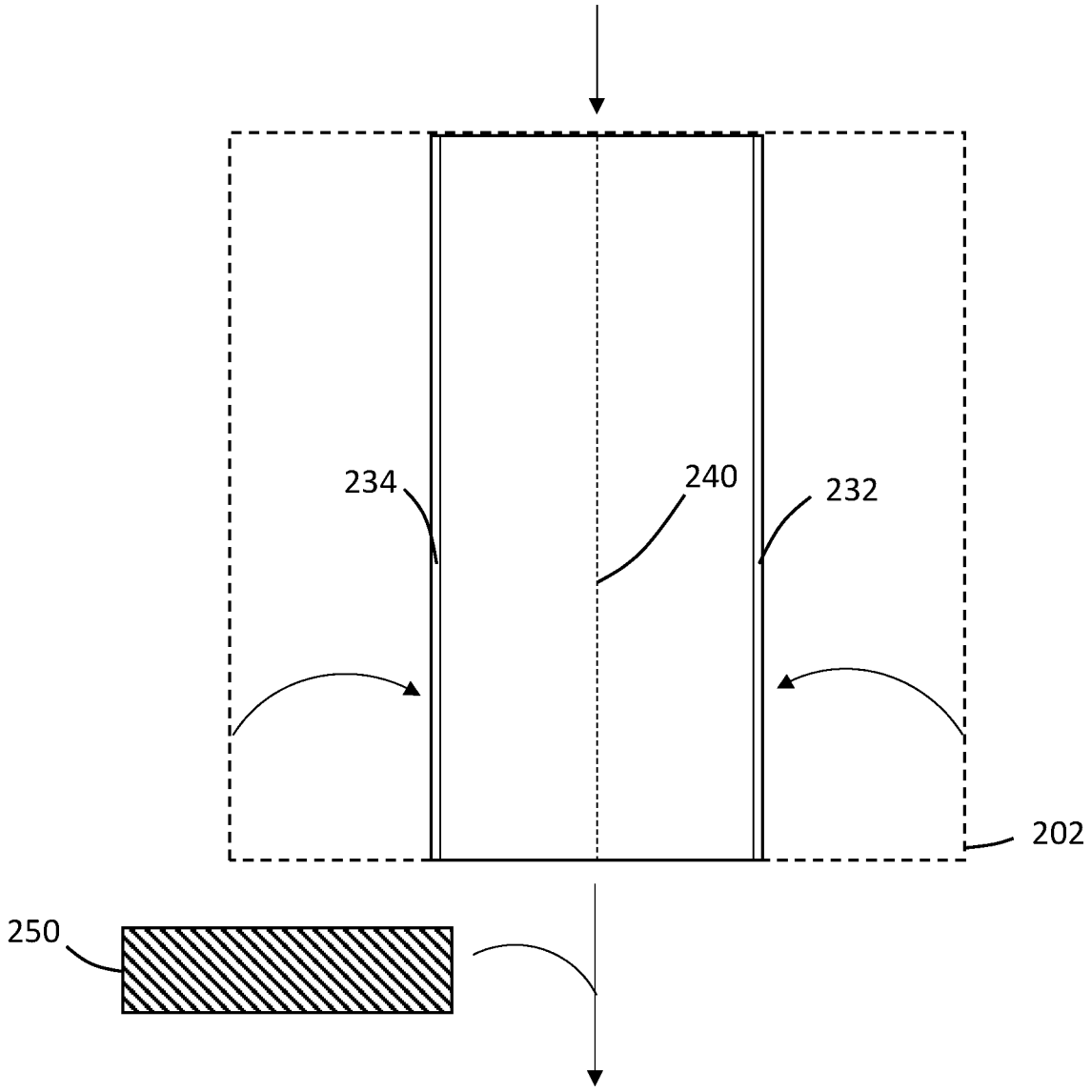

FIGS. 2A-D are schematic top plan views of a recyclable film 200 and resealable closure 250 in initial steps of an embodiment of forming a recyclable pouch from rollstock. The recyclable film 200 is shown in FIG. 2A. The dashed line in FIG. 2A illustrates the underlying roll of the roll stock. The film 200 may be pulled through pouch manufacturing equipment where it may be folded, for example, by passing by a plow. A leading portion 202 of the film 200 is pulled through the manufacturing equipment. In FIG. 2B, the film 200 is shown as partially folded. The dashed rectangle illustrates the outline of the unfolded film rollstock 200 position shown FIG. 2A. The dashed line in the film illustrates a crease 240 that may form as the film rollstock is folded by the plow, upstream. The film may be folded in any suitable manner such that crease 240 forms a bottom portion of the pouch or such that length at 240 serves to form a gusset at the bottom of a stand-up pouch. The manner in which the film is formed, and the plow or other folding apparatus used will, at least in part, determine nature of the bottom portion of the pouch.

In FIG. 2B, lateral lengths 232, 234 of the folded film rollstock will serve to form the top the finished pouch. As the film is being folded, resealable closure 250 may be introduced to contact the inner surfaces of the folded film. The inner surface of the folded film comprises the heat seal layer (such as heat seal layer 220 illustrated in FIG. 1).

Figure 2C:
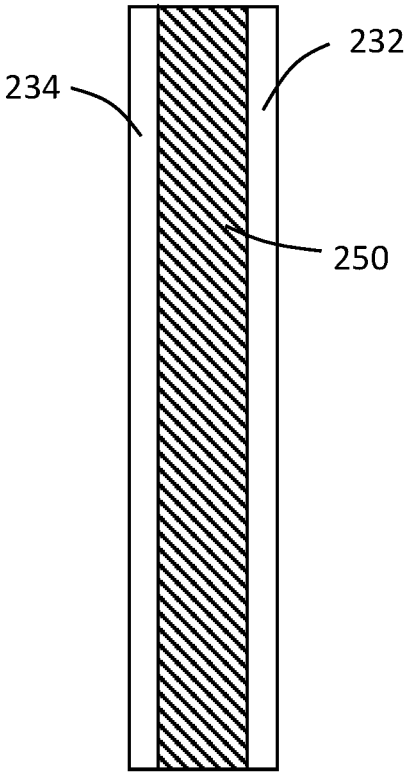

In FIG. 2C, the resealable closure 250 is in contact with the inner surface of the folded film rollstock, preferably below what will be the top edge of the finished pouch, and between the interface of lengths 232, 234. The resealable closure 250 is attached to the inner surfaces of the opposing lateral sides of the film. For example, the resealable closure 250 may be heat sealed to the film.

Figure 2D:
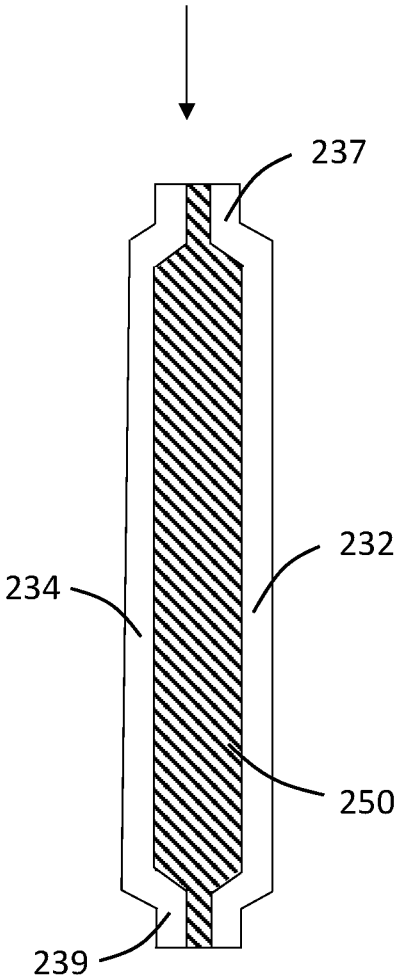

In FIG. 2D, the portions 237, 239 of the film rollstock forming what will be the side edges of the pouch may be crushed to flatten the resealable closure 250 in portions 237, 239. The crushing may require heat and pressure to sufficiently flatten the resealable closure 250, which heat and pressure is applied to the exterior of the film. Because the exterior of the film (e.g., the second layer) has a melting temperature that is at least 30° C. greater than the inner heat seal layer, the exterior surface of the film may sufficiently withstand the applied heat and pressure without causing damage to the film. In high speed manufacturing processes, the dwell time of the crush on the film is limited. Due to the limited dwell time, increased temperatures are needed to sufficiently flatten the resealable closure 250. Preferably, the mass or density of polymer of the resealable closure 250 is low to allow melting and/or deformation at the temperatures, pressures, and dwell times employed on high speed manufacturing lines. For example, the mass density of the polymer of the resealable closure 250 is 2.75 g per linear foot or less, such as 2.5 g per linear foot or less, or 2.0 g per linear foot or less.

Figure 3:
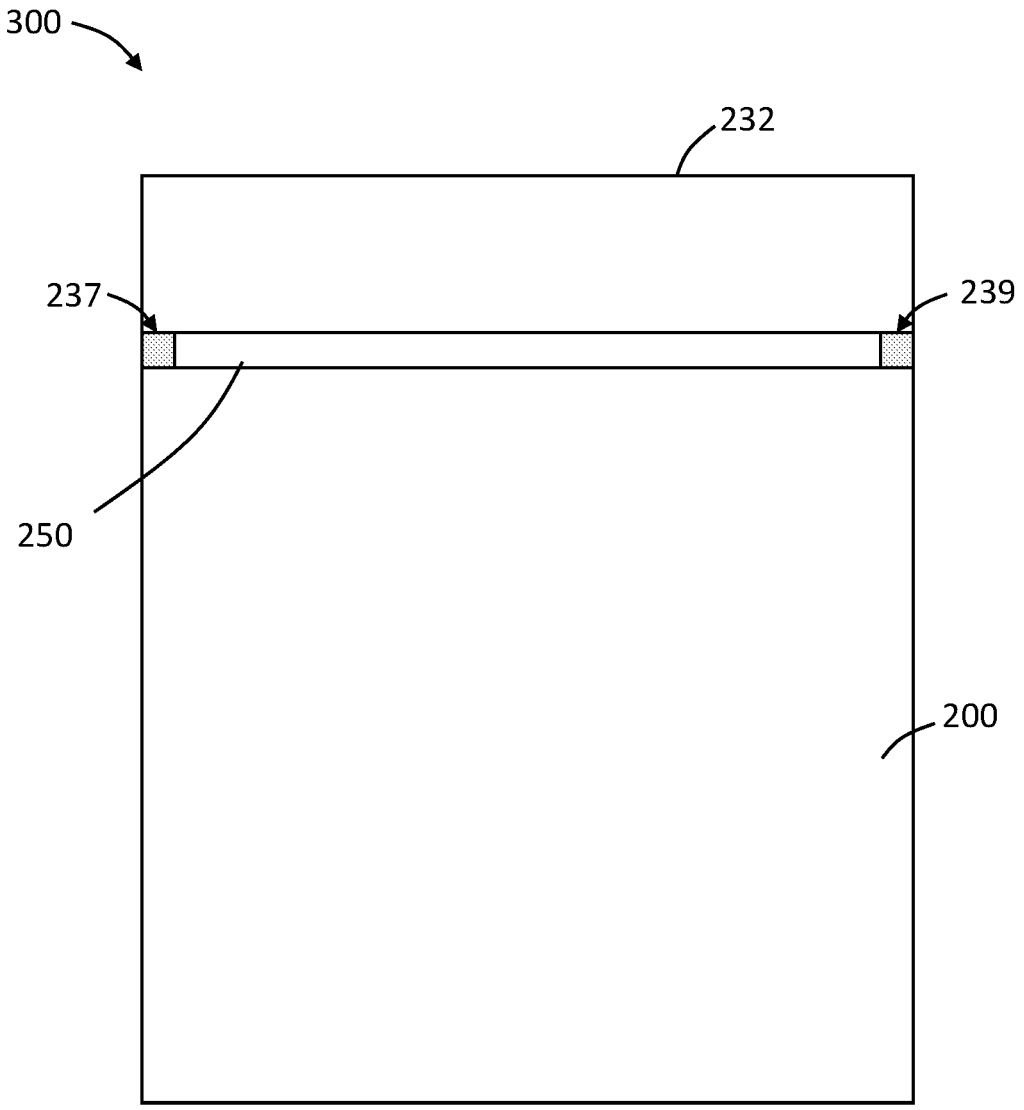
FIGS. 3-6 are schematic side plan views of a pouch or a precursor to a pouch illustrating stages of an embodiment of manufacturing a recyclable pouch.

Referring to FIG. 3, a schematic side plan view of a precursor to a recyclable pouch 300 formed from rollstock is shown. The pouch 300 precursor includes a folded recyclable film 200 and an attached resealable closure 250. The pouch 300 precursor shown in FIG. 3 is at a similar stage of manufacturing as the pouch precursor shown in FIG. 2B. That is, the resealable closure 250 is attached to opposing inner surfaces of the folded film 200, such as by heat sealing, and the closure 250 is flattened at the edges of the pouch at regions 237 and 239. The top edge 232 of the front side of the pouch 300 is shown in FIG. 3. The closure 250 is located below the top edge 232.

Figure 4:
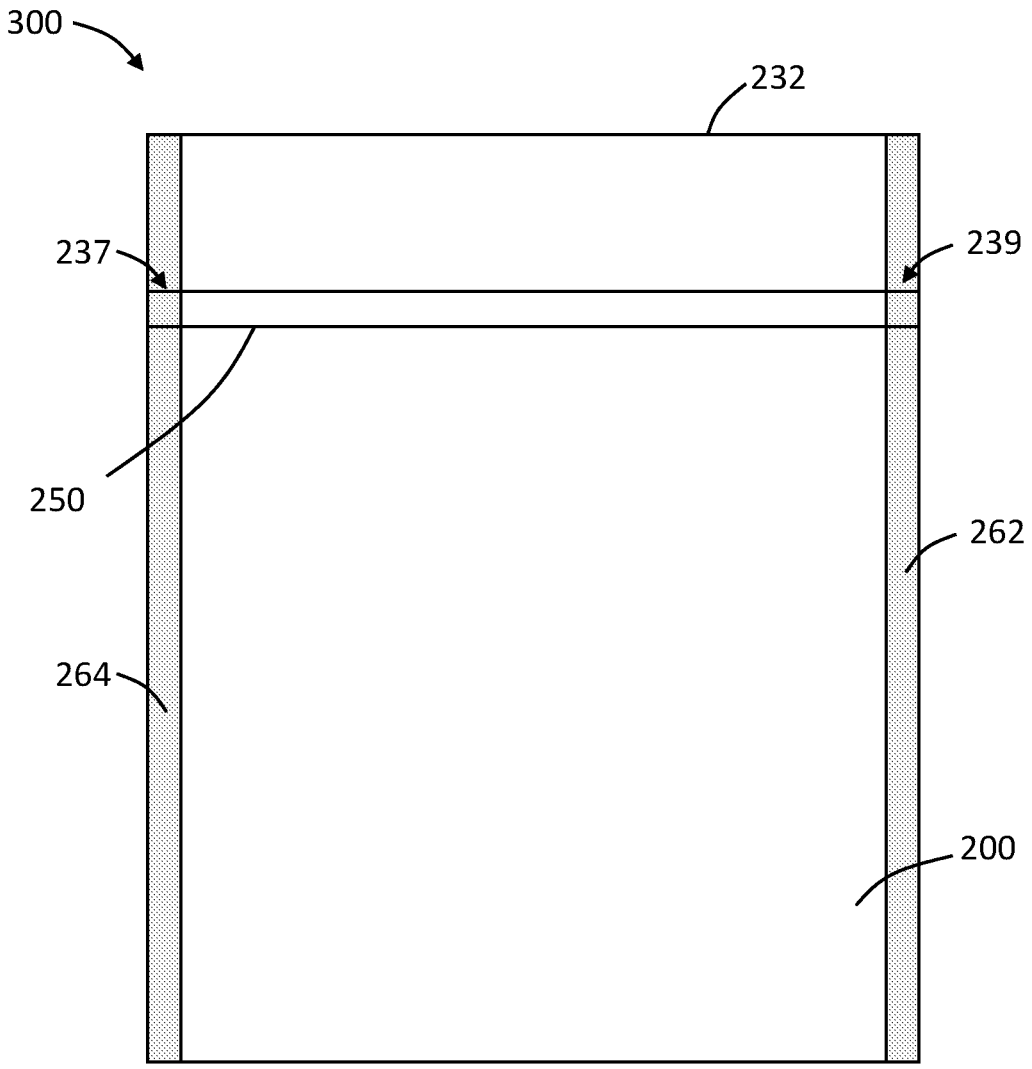

Referring to FIG. 4, the side edges of pouch 300 are heat sealed between interior heat seal layers to form heat seals 262, 264. Because the edges of the closure 250 are sufficiently flattened at edge regions 237, 239, uniform heat seals 262, 264 are formed along the entire edges of the recyclable pouch 200.

Figure 5:
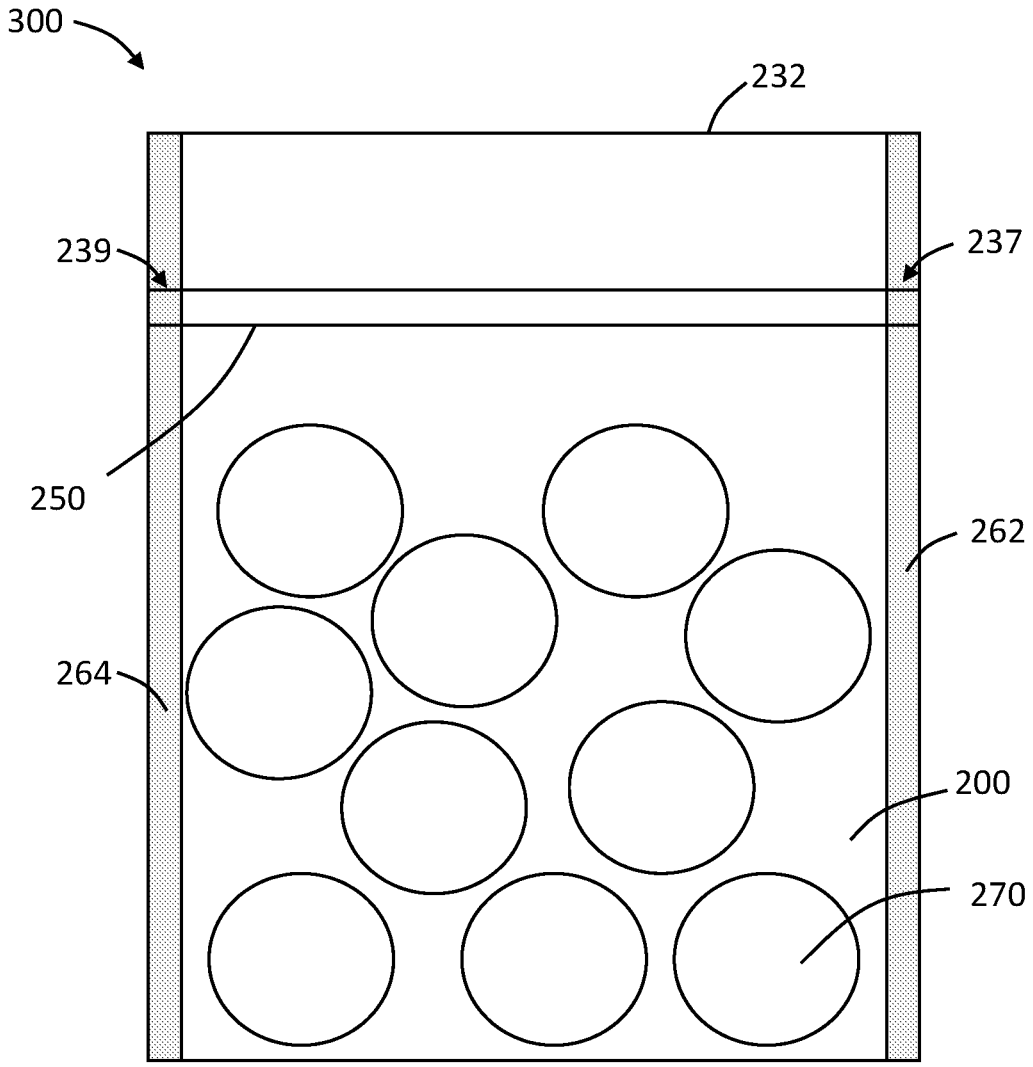

Referring to FIG. 5, the opposing layers of the top edge (only the front top edge 232 is shown) may be separated and the resealable closure may be opened to allow the pouch 300 to be filled with one or more articles 270. In the depicted embodiment, the film 200 is shown as transparent so that articles 270 in the interior of the pouch 300 are visible.

Figure 6:
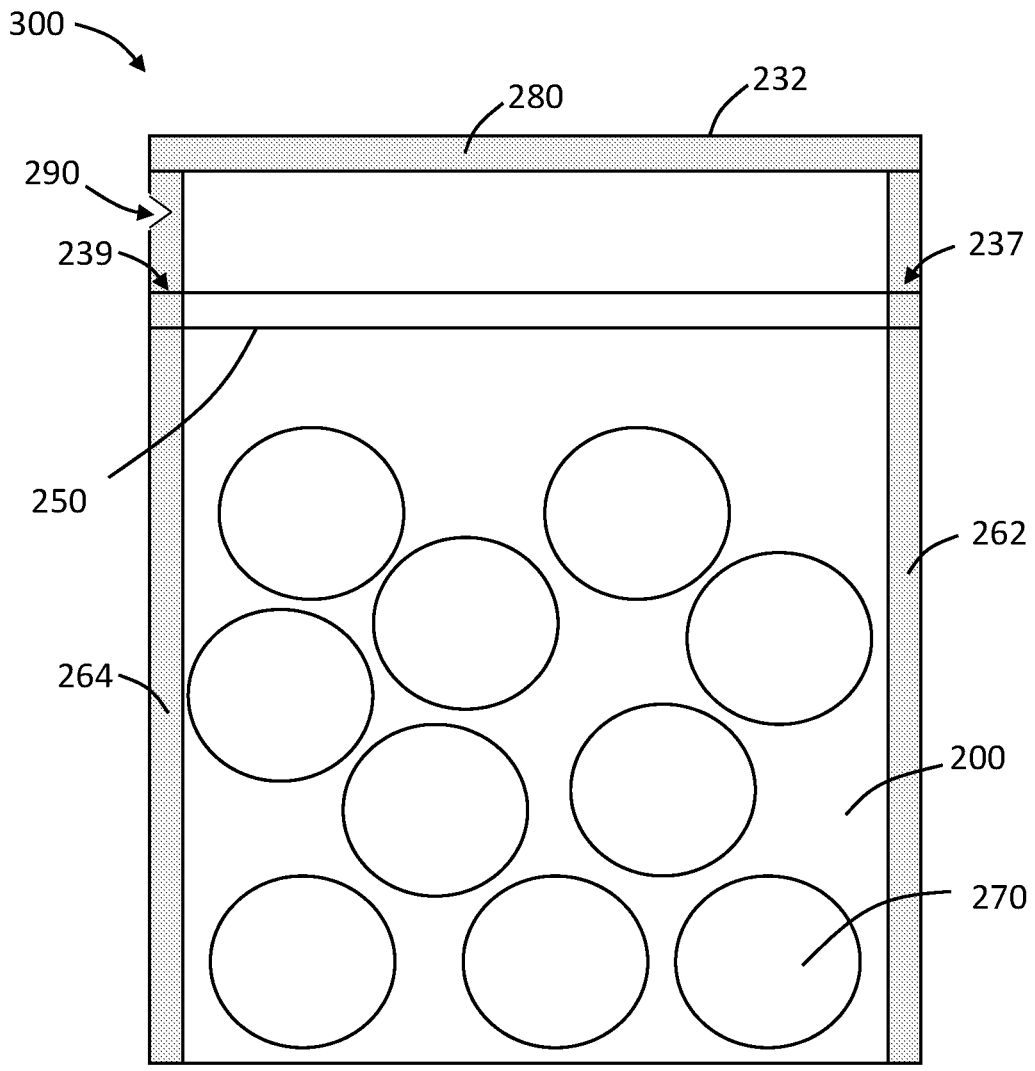

Referring to FIG. 6, opposing interior surfaces of the film 200 may be heat sealed in proximity to the top edge 232 of the pouch 300 to form heat seal 280. A notch 290, perforation, or the like may be introduced between the top heat seal 280 and the closure 250 to facilitate tearing of the film 200 above the resealable closure 250 by a consumer. The notch 290 preferably does not extend beyond the side heat seal 264 so that a heat seal barrier around the articles 270 remains intact.

A pouch as schematically illustrated in FIG. 6 may be formed by any suitable process from film rollstock. Similarly, any suitable equipment may be used to perform the process illustrated and described regarding FIGS. 2A-D and 3-6. Preferably, the process includes forming, cutting apart, filling, and then sealing the pouches on a single HFFS manufacturing line. Preferably, the process is a high-speed process. For example, the process may produce 70 or more filled pouches in a minute, such as 75 or more or 80 or more pouches in a minute. Preferably, the process is a horizontal form-fill-seal process.

Figure 7:
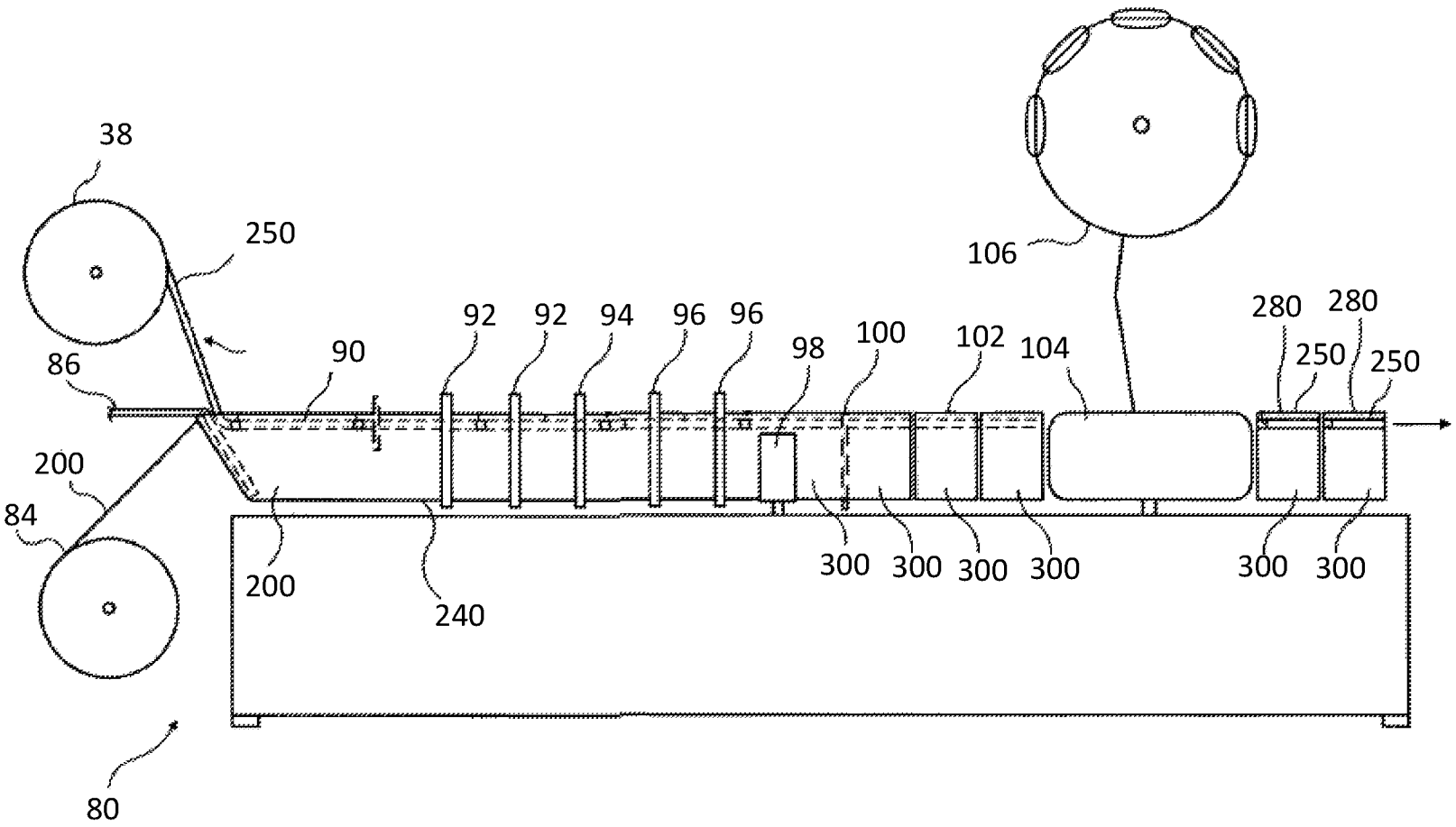
FIG. 7 is a schematic drawing showing an embodiment of pouches being made using horizontal form-fill-seal equipment.

Referring now to FIG. 7, an embodiment of a horizontal form-film-seal process for manufacturing a recyclable pouch from rollstock is shown. Recyclable film 200 is provided on a roll 84. Downstream a pull roller 98 or other suitable apparatus is provided for driving the film 200 through the machine. A folder plow 86 positioned downstream of the film roll 84 folds the film 200 about a bottom crease 240 to form opposing pouch walls. An elongate source of interlocked resealable closure 250 is provided on a roll 38 and fed between the advancing package walls.

At a first sealing station 90, the interlocked closure 250 is sealed to the opposing pouch walls.

Then at crushing stations 92, the ends of the closure 250 for a given package are stomped. To achieve high speed production, such as 70 bags per minute, the dwell time of stomping apparatus on the film is less than one second, such as 0.5 seconds or less. To sufficiently flatten the closure so that a suitable heat seal may be later formed along the entire side edge(s) of the pouch, the temperature of the crushing apparatus that contacts the pouch walls must be sufficiently high due to the short dwell time. The inventors have found that having a film with an outer layer having a melting temperature of at least about 30° C. greater than the melting temperature of the inner heat seal layer provides sufficient temperature resistance and heat transfer to achieve sufficient heat to be applied to achieve sufficient flattening for a quality seal to be later formed without compromising the integrity of the outer layer of the film rollstock.

At station 94, the zipper crush locations may be cooled via a platen and a skirt "k" seal may be applied.

At second sealing station 96, the folded film and closure are cross-sealed to form discrete pouches.

The closure and film are advanced when pull rollers 98 or other suitable apparatus are activated.

At a cutting station 100 the individual pouches 300 are cut from one another and placed onto grippers, then indexed forward.

At station 102, the closures are opened to fill the pouches. This is achieved at an opening station 96, where suction may be applied to the exterior of the pouch walls to open the closure.

The separated pouches 300 are then taken to filling station 104 where they are filled. The pouches 300 may be filled by a filling turret 106, or the pouches may be filled in-line.

After filling, the top opening of pouch may be closed. Finally, a seal 280 seal may optionally be provided above the closure 250. Completed filled pouches 300 are then output from the machine.

It will be understood that stations of HFFS equipment, such as the equipment depicted in, and described regarding, FIG. 7, may be somewhat modular and that the order of some of the process steps may be changed. For example, it may be desirable to form the side edge heat seal (at station 96) prior to crushing the edges of the closure (at station 92). In such cases, side seal platens may have a machined space at the location of the zipper. Once the zipper is crushed through application of heat and pressure, the side seal may be completed by sealing the space corresponding to the machined space in the platen.

Referring now to FIGS. 8A-G, schematic side views of sections of film 200 rollstock corresponding to pouches to be formed are shown, illustrating stages of a HFFS process that may be applied in forming the pouch. The shaded areas correspond to application of heat to the film 200. The unshaded areas correspond to application of pressure only or cooling and pressure. An edge 232 of the film 200 that will form a top edge of the pouch is shown.

Figure 8A:
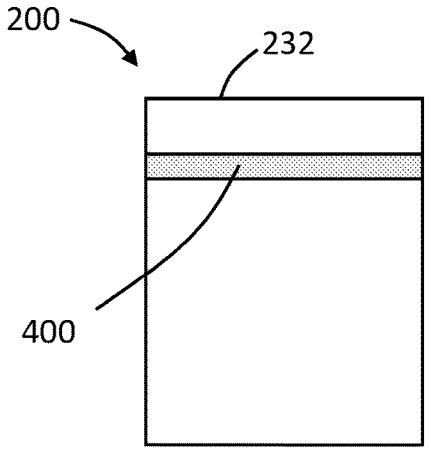
FIGS. 8A-G are schematic side plan views of sections of film 200 rollstock corresponding to pouches to be formed, illustrating some stages of a HFFS process that may be applied in forming the pouch.
Figure 8B:
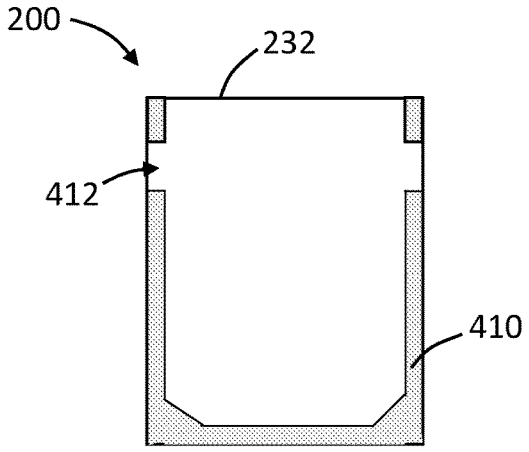
Figure 8C:
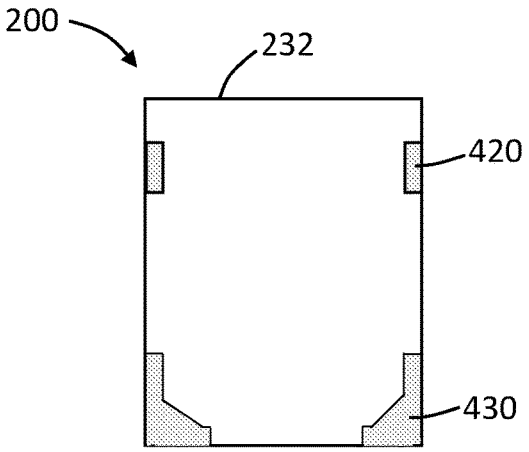
Figure 8D:
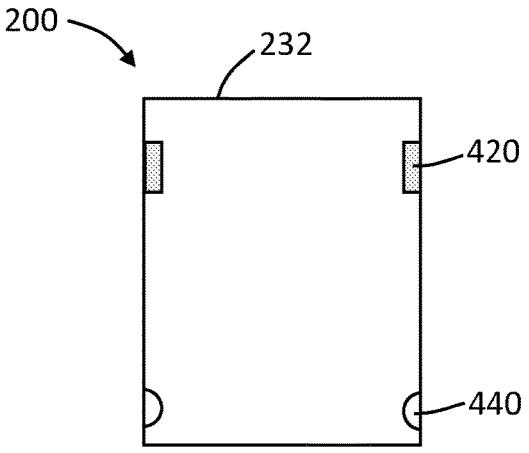
Figure 8E:
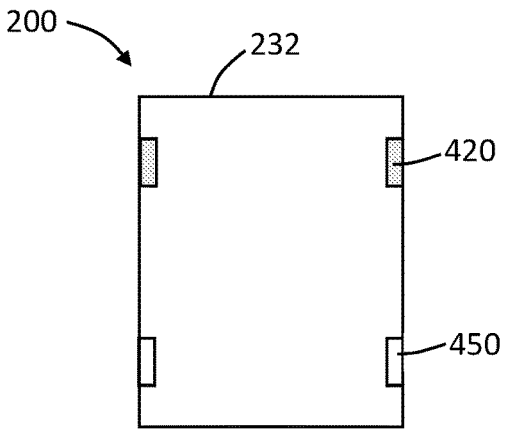
Figure 8F:
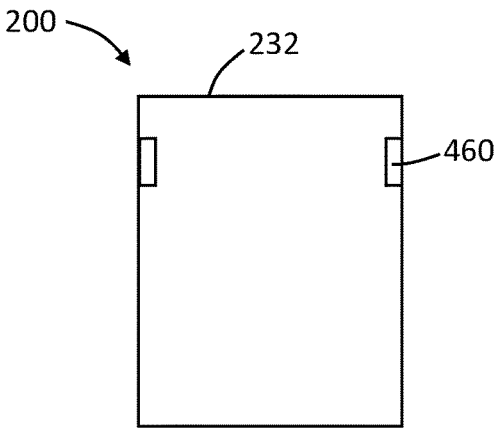
Figure 8G:
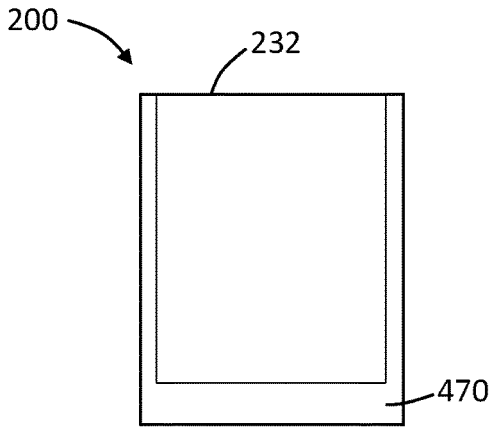

In FIG. 8A, the film 200 is shown as folded and heat and compression are applied at area 400 to seal the closure to the inside of the pouch. In FIG. 8B, heat and compression are applied to the sides and bottom at area 410 to seal the sides and bottom. The bottom is sealed to form a skirt. Heat and compression may be applied by a platen having a machined space such that heat and compression are not directly applied to the side edges at a location 412 in proximity to the closure. In FIG. 8C, heat and compression are applied at area 420 to crush the closure and complete the side seal along the side of the pouch. Heat and compression are also applied at area 430 to form a gusset and apex seal. In FIG. 8D, heat and compression are applied at area 420 to further crush the closure and ensure complete the side seal along the side of the pouch. Portions of the film 200/pouch are knocked out in the gusset at areas 440. In FIG. 8E, heat and compression are applied at area 420 to further crush the closure and ensure complete the side seal along the side of the pouch (the steps in FIGS. 8B-F together form a side seal along the length of the side edges). The apex areas 450 are compressed without heat. In FIG. 8F, the zipper edge areas 460 are cooled by compression with platens having coolant flowing through the platens. In FIG. 8G, the sides and bottom skirt areas 470 are cooled by compression. The article shown in FIG. 8G may be cut to form a pouch that may be filled.

The pouches and processes described herein may be used to package any suitable article within the pouch. In some embodiments, the packaged article is foodstuff.

Any suitable foodstuff can be contained or sealed within a pouch as described herein. The foodstuffs can be raw or natural foodstuffs or processed foodstuffs. Food processing includes the transformation of raw ingredients into food or transforming forms of food into other forms of food. Food processing often includes using harvested crops or animal products to produce marketable and often long shelf-life products. Processed foodstuffs include products for which additional processing by a consumer may be desired prior to consumption. For example, a foodstuff for which heating, cooking, baking, or the like, may be desired by a consumer prior to consumption may be a processed foodstuff despite not being in its final form (e.g., being unheated, uncooked, unbaked, etc.) prior to delivery to a consumer.

Examples of processed foodstuffs that may be contained or sealed within a package as described herein include a confectionary, a gum, a bakery product, an ice cream, a dairy product, a fruit snack, a chip or crisp, an extruded snack, a tortilla chip or corn chip, a popcorn, a pretzel, a nut, a snack bar, a meal replacement, a ready meal, a soup, a pasta, a canned food, a frozen processed food, a dried processed food, an instant noodle, a chilled processed food, an oil or fat, a sauce dressing or condiment, a dip, a pickled product, a seasoning, a baby food, a spread, a chip or a crisp such as chips or crisps comprising potato, corn, rice, vegetable (including raw, pickled, cooked and dried vegetables), a fruit, a grain, a soup, a seasoning, a baked product such as a ready-to-eat breakfast cereal or granola, hot cereal or dough, an ice cream such as a frozen yogurt, a dairy products such as a yogurt or cheese, ready meal, a soup, a pasta, a canned food, a frozen processed food, a dried processed food, an instant noodle, or a chilled processed food, a beverage including beverages that include fiber or protein a meat or a meat substitute, a pet food, an animal product, and a medical food.

In some embodiments, a foodstuff that may be contained or sealed within a package as described herein includes a vitamin supplement, an infant formula product, a medicinal or pharmaceutical product, or the like.

Definitions

All scientific and technical terms used herein have meanings commonly used in the art unless otherwise specified. The definitions provided herein are to facilitate understanding of certain terms used frequently herein and are not meant to limit the scope of the present disclosure.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising" and the like. As used herein, "consisting essentially of,"

as it relates to a product, method or the like, means that the components of the product, method or the like are limited to the enumerated components and any other components that do not materially affect the basic and novel characteristic(s) of the product, method or the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

Also herein, the recitations of numerical ranges by endpoints include all numbers subsumed within that range (e.g., 1 to 5 includes 1, 1.5, 2, 2.75, 3, 3.80, 4, 5, etc. or 10 or less includes 10, 9.4, 7.6, 5, 4.3, 2.9, 1.62, 0.3, etc.). Where a range of values is "up to" a particular value, that value is included within the range.

As used herein, the term "about" encompasses the range of experimental error that occurs in any measurement.

As used herein, "providing" means purchasing, manufacturing, or otherwise obtaining the provided article.

As used herein, a pouch or bag that is "filled" is a pouch or bag into which an article has been placed. The pouch or bag need not be filled to capacity to be considered "filled."

Thus, methods, systems, devices, compounds and compositions for RECYCLABLE POUCH HAVING RESEAL CLOSURE OVERLAPPING AN EDGE SEAL, FORMED FROM ROLLSTOCK FILM, ON HIGH SPEED PACKAGING MACHINERY are described. Various modifications and variations of the layers, films, packages, packaged products and methods disclosed herein will be apparent to those skilled in the art without departing from the scope and spirit of the disclosure. Although aspects of layers, films, packages, packaged products and methods have been described in connection with specific preferred embodiments, the claims that follow should not be unduly limited to such specific embodiments. Indeed, various modifications of the described modes which are apparent to those skilled in chemistry; film and package manufacturing; or related fields are intended to be within the scope of the following claims.

The invention claimed is:

1. A method for forming a filled recyclable pouch having a sealing closure that extends to side edges of the pouch, the method performed by horizontal form-fill-seal (HFFS) equipment, the method comprising:

(a) providing a multi-ply film rollstock having a heat seal layer and a second layer having a melting temperature of at least 30° C. greater than a melting temperature of the heat seal layer, wherein the multi-ply film is recyclable;

(b) providing an elongate source of resealable closure;

(c) providing an article to be placed in the pouch;

(d) advancing a leading portion of the multi-ply film from the rollstock through the HFFS equipment;

(e) folding the advancing film such that the heat seal layer on a first side of the folded film is adjacent the heat seal layer on a second side of the folded film;

(e) applying the elongate source of resealable closure to the folded film such that the elongate source of resealable closure contacts the heat seal layer of the first side of the folded film and contacts the heat seal layer of the second side of the folded film;

(f) applying heat and pressure to the folded film and applied elongate source of resealable closure to seal the elongate source of resealable closure to the heat seal layers of the first and second sides of the folded film, wherein the heat and pressure are applied to locations of the folded film that correspond to the side edges of the pouch to be formed, wherein the application of heat and pressure cause the elongate source of resealable closure to sufficiently flatten at locations that correspond to the side edges of the pouch to be formed;

(g) applying heat and pressure to the folded film with the applied elongate source of resealable closure to seal the heat seal layers of the first and second sides of the folded film, wherein the heat and pressure are applied to locations of the folded film that correspond to the side edges of the pouch to be formed;

(h) cutting the folded film with the sealed elongate source of resealable closure and side edge seals to form pouches having a bottom, sealed side edges, an unsealed top, and a sealing closure between the bottom and the top and extending to the side edges;

(i) filling the pouch with an article; and (j) sealing top of the pouch, wherein formed, cut apart, filled, and then sealed pouches are produced at a rate of at least 70 pouches per minute.

2. The method of claim 1, wherein step (f) is performed before step (g).

3. The method of claim 1, wherein step (g) is performed before step (f).

4. The method of claim 3, wherein, in step (g), the side edges are sealed along a length of the sides except for a region surrounding the closure, leaving unsealed side edge portions in proximity to the closure, and wherein, in step (f), the application of heat and pressure to cause the elongate source of resealable closure to sufficiently flatten at locations that correspond to the side edges of the pouch seals the unsealed side edge portions in proximity to the closure to provide a continuous seal along the length of the sides.

5. The method of claim 1, wherein the melting temperature of the second layer is at least 40° C. greater than the melting temperature of the heat seal layer.

6. The method of claim 1 wherein the melting temperature of the second layer is from 40° C. to 60° C. greater than the melting temperature of the heat seal layer.

7. The method of claim 1 wherein the heat seal layer and the second layer comprise polyethylene.

8. The method of claim 1 wherein the resealable closure comprises a heat sealable polymer having a weight per foot of 2.75 g per linear foot or less.

9. The method of claim 1 wherein at least 70 bags per minute are formed, filled, and sealed.

10. The method of claim 1 wherein the formed, filled, and sealed pouches are produced at a rate of at least 75 or more pouches per minute.

11. The method of claim 1 wherein the formed, filled, and sealed pouches are produced at a rate of at least 80 or more pouches per minute.

12. The method of claim 1 wherein the article is a food product.

* * * * *